United States Patent [19]

Wilson

[11] 3,955,865

[45] May 11, 1976

[54] OVEN DOOR COUNTERBALANCE SYSTEM

[75] Inventor: Arthur C. Wilson, 108 Ashland Ave., Louisville, Ky.

[73] Assignee: General Electric Company, Louisville, Ky.

[22] Filed: Nov. 4, 1974

[21] Appl. No.: 520,722

[52] U.S. Cl. ..... 312/319; 49/386; 126/191; 312/139

[51] Int. Cl.[2] ..... F23M 7/00; A47B 88/00

[58] Field of Search ..... 49/386, 258; 312/319, 312/276, 274, 272, 271, 139; 126/340, 191

[56] References Cited

UNITED STATES PATENTS

| | | | |
|---|---|---|---|
| 1,979,210 | 10/1934 | Rogers | 126/191 X |
| 2,731,011 | 1/1956 | Maier | 126/191 |
| 3,049,115 | 8/1962 | Carnahan et al. | 312/319 X |
| 3,250,267 | 5/1966 | Fry | 126/191 |
| 3,437,087 | 4/1969 | Price | 126/191 |
| 3,453,779 | 7/1969 | Refenberg | 49/386 |
| 3,453,996 | 7/1969 | Agee | 126/191 |
| 3,738,727 | 6/1973 | Race | 312/319 |
| 3,842,542 | 10/1974 | White et al. | 49/386 |

*Primary Examiner*—James T. McCall

*Attorney, Agent, or Firm*—Richard L. Caslin; Francis H. Boos

[57] ABSTRACT

A door construction for an appliance such as a baking and broiling oven for domestic use. The door has a counterbalance spring mechanism at each side of the door that includes a swing link interposed between the tension spring and the hinge lever of the door to obtain a door balancing torque that substantially follows the torque of the door as it moves between a vertical closed position and a horizontal fully open position.

6 Claims, 4 Drawing Figures

OVEN DOOR COUNTERBALANCE SYSTEM

BACKGROUND OF THE INVENTION

1. Field of the Invention:

This invention relates to a drop-down door construction, such as for use on a cooking oven or automatic dishwasher. The door is provided with a counterbalance spring system that is tailored to balance the weight of the door and assist in the opening and closing movements of the door.

2. Description of the Prior Art:

The present invention is particularly useful as the counterbalance system for the door of a built-in wall oven or a range construction that is not provided with a drawer space or other extension beneath the oven which would otherwise allow the use of a generally vertical counterbalance tension spring. If there is little space beneath the oven, then the counterbalance tension spring must be arranged in a generally horizontal position, and attached at one end to the oven cabinet near the rear thereof. There is a certain amount of adjustability available in the prior art door counterbalance systems in order to accommodate oven doors of different weights depending upon whether they are solid doors, that is without a window; or an oven door with a window; or a door with a full glass front panel with a small window, which is widely being used in the oven art at this time; or the door of a pyrolytic self-cleaning oven which is much thicker in order to accommodate an extra amount of thermal insulation and door gasket material for sealing the door during the high temperature self-cleaning cycle. In such cases, it is possible to attach the tension spring in a variety of different attachment slots in order to change the initial tension applied to the spring, as well as its angle of operation.

One example of a counterbalance spring mechanism for an oven door that employs a vertical tension spring is shown in the patent of Roy D. Chisholm and William J. Cleary U.S. Pat. No. 3,132,640, which is assigned to the same assignee as is the present invention. Another counterbalance spring patent showing a variety of modifications of either vertical or horizontal tension springs is shown on a dishwasher; namely, U.S. Pat. No. 3,453,779.

The principal object of the present invention is to provide a drop-down door construction with a counterbalance spring mechanism where the door balancing torque substantially equals the torque of the door as it moves between a vertical closed position and a horizontal fully open position.

A further object of the present invention is to provide a door counterbalancing system of the class described employing a generally horizontal tension spring in cooperation with a swing link such that the moment art of the door balancing torque increases during the latter portion of the door movement from the vertical closed position to a horizontal fully open position.

A further object of the present invention is to provide a counterbalance system of the class described without relying on a complete system of rollers acting upon cam surfaces on the hinge lever so as to minimize relative movement, friction, wear and noise between the parts.

SUMMARY OF THE INVENTION

The present invention, in accordance with one form thereof, relates to an appliance having an outer cabinet with a front-opening access door. The door has hinge means joining the door to the cabinet so that the door may move between a vertical closed position and a generally horizontal fully open position. The hinge means includes a hinge lever pivotally connected to the door and extending through a slot in the front frame of the cabinet. A link member is pivotally connected to the hinge lever at one end and to a tension spring at its other end. This link member is attached to the hinge lever at a point outwardly at the front frame when the door is in its horizontal fully open position.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENT

Figure 1:
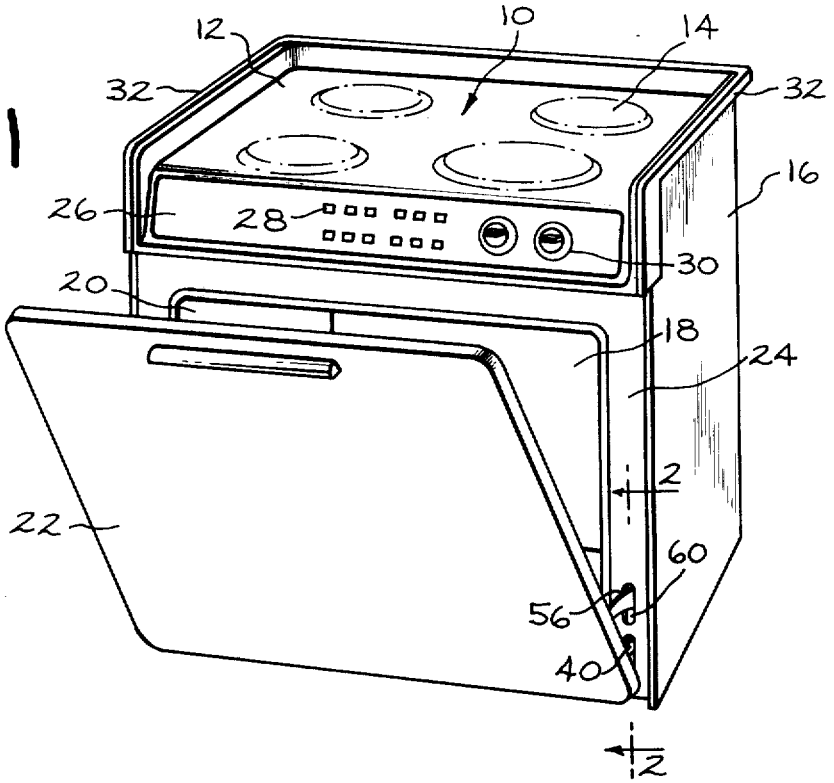
FIG. 1 is a front perspective view of a slide-in electric range having a lower oven with a counterbalanced door mechanism of the present invention.

Turning now to a consideration of the drawings and in particular to FIG. 1, there is shown for illustrative purposes an electric range 10 having a top cooking surface 12 with a plurality of surface heating elements 14. This range has an outer body or cabinet construction 16 which supports the cooktop 12 and a baking and broiling oven 18 located beneath the cooktop. This oven includes a box-like oven liner 20 and a front-opening drop-door 22 that form the oven cooking cavity. The range cabinet 16 includes a front frame 24 which surrounds the front opening of the oven liner 20. A control panel 26 is shown arranged along the front edge of the cooktop 12, and it contains a plurality of control components 28 for controlling the four surface units 14, as well as oven controls 30 for controlling the lower oven 18. This particular range 10 is adapted to be supported in a notchedout kitchen cabinet (not shown) such that the range may be slid into the space between the kitchen cabinets by means of side rails 32 that are arranged on the opposite sides of the cooktop 12 for suspending the range from these rails bearing upon the edges of the countertop rather than having the range supported directly from the kitchen floor. Attention is directed to the fact that this range is not provided with a storage drawer beneath the oven 18, such that there is little vertical depth of the range beneath the oven proper. A similar oven construction without the cooktop 12 would be used when the oven is designed to be built into the wall of the kitchen.

While an electric range has been shown embodying the door counterbalancing system of the present invention, it will readily be apparent to those skilled in this art that the invention could be used on a gas heated oven, or on an automatic dishwasher, or in fact any applicance or cabinet having a drop-down door.

Figure 3:
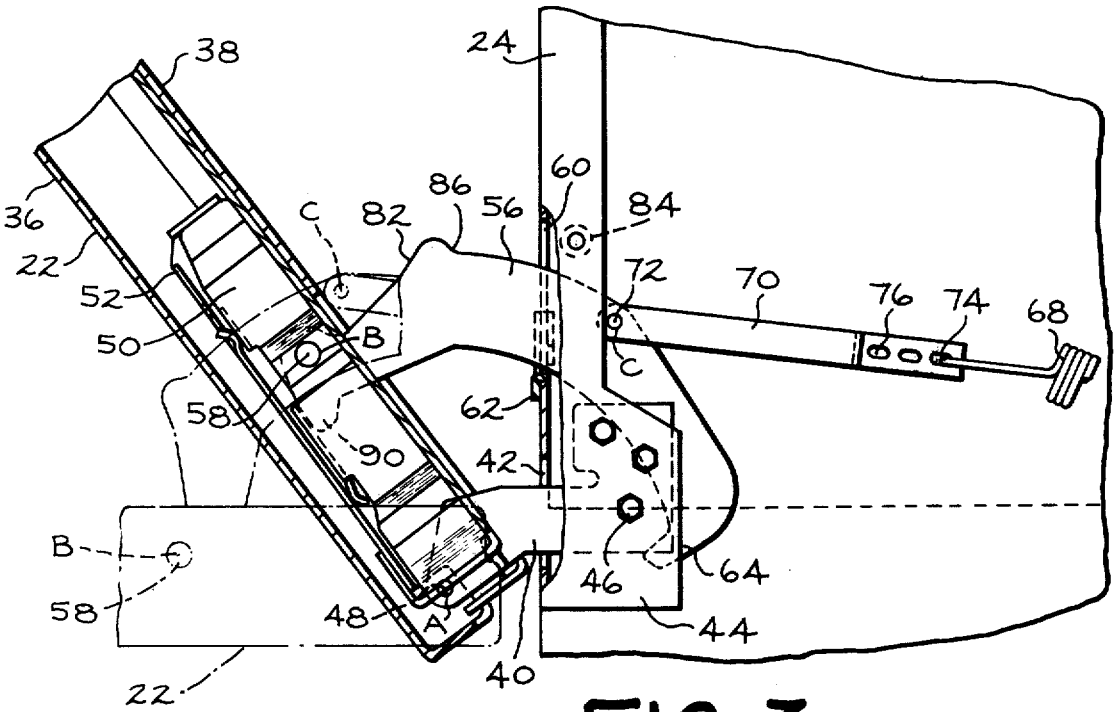
FIG. 3 is a cross-sectional, elevational view similar to that of FIG, 2 showing the oven door in a partially open position when the pivoted hinge lever engages the door and becomes fixed or rigid with respect thereto as the door continues to move to its horizontal fully open position.

Now turning to a fragmentary side, cross-sectional, elevational view of FIG. 3, the oven door 22 is shown of generally hollow sheet metal design having an outer panel 36 and an innermost panel 38. Actually, the door 22 would be furnished with thermal insulating material in order to retard the escape of heat from the oven cooking cavity, but the insulation is not shown since it does not form part of the present invention, and it simplifies the description of the present invention to leave out unrelated structural details.

The oven door 22 has a hinge means at each side of the door adjacent its lower edge in the form of a fixed bracket 40 that protrudes forwardly through a slot 42 in the front frame 24. The innermost end of this bracket 40 is bolted to a flange 44 by means of fastening screws 46. The outermost end of the hinge bracket 40 includes a hinge pin 48 on which is pivotally supported a door guide 50 in the form of a short post which is adapted to slide into a door guide sleeve 52 built within the door, in the manner of a snug fit so that the door does not wobble with respect to the door guide. For a better understanding of the nature of this door guide 50 and door guide sleeve 52 attention is directed to a recently issued patent of James A. White and Peter Nowosielski U.S. Pat. No. 3,842,542, entitled "Removable Oven Door Hinge System", which is also assigned to the assignee of the present invention. Thus, the oven door 22 is shown as a removable oven door which has several important advantages. However, the present invention does not need to be combined with a removable oven door. The presence of a removable oven door design helps in the task of standardization so as to hold down the total number of different parts in factory inventory by making it possible to assemble different door designs on the same basic oven door hinge system depending on whether or not the customer wants a solid oven door, a window in the door, or a full glass front on the door.

The oven door 22 carries a hinge lever 56 that is pivotally connected to the door guide 50 by a pivot pin 58. A vertical elongated slot 60 is formed in the front frame 24 of the oven cabinet generally over the slot 42 that accommodates the fixed bracket 40. Since the hinge lever 56 is pivoted to the door guide 50, and the door 22 is assembled on the door guide, the hinge lever is in effect pivoted to the door through the intermediary of the door guide 50. The hing lever 56 is of thin steel stock, and generally of arcuate form so that the slot 60 may be kept as short as possible in order to accommodate the movement of the hinge lever through the slot as the door moves from a vertical closed position to a horizontal fully open position. A generally U-shaped nylon bushing 62 is mounted near the lower portion of the slot 60 to serve as a guide and also prevent metal-to-metal contact between the hinge lever 56 and the sides of the slot 60 so as to prevent any rubbing noise from creating a disturbance.

The innermost end of the hinge lever 56 is provided with a downwardly directed hook member 64 which is adapted to engage the inner side of the front frame 24 as the oven door 22 reaches its horizontal fully open position. This hook member serves as a stop means to prevent further downward movement of the door, such that the door may be used as a support platform to aid in loading and unloading food from the oven.

Figure 2:
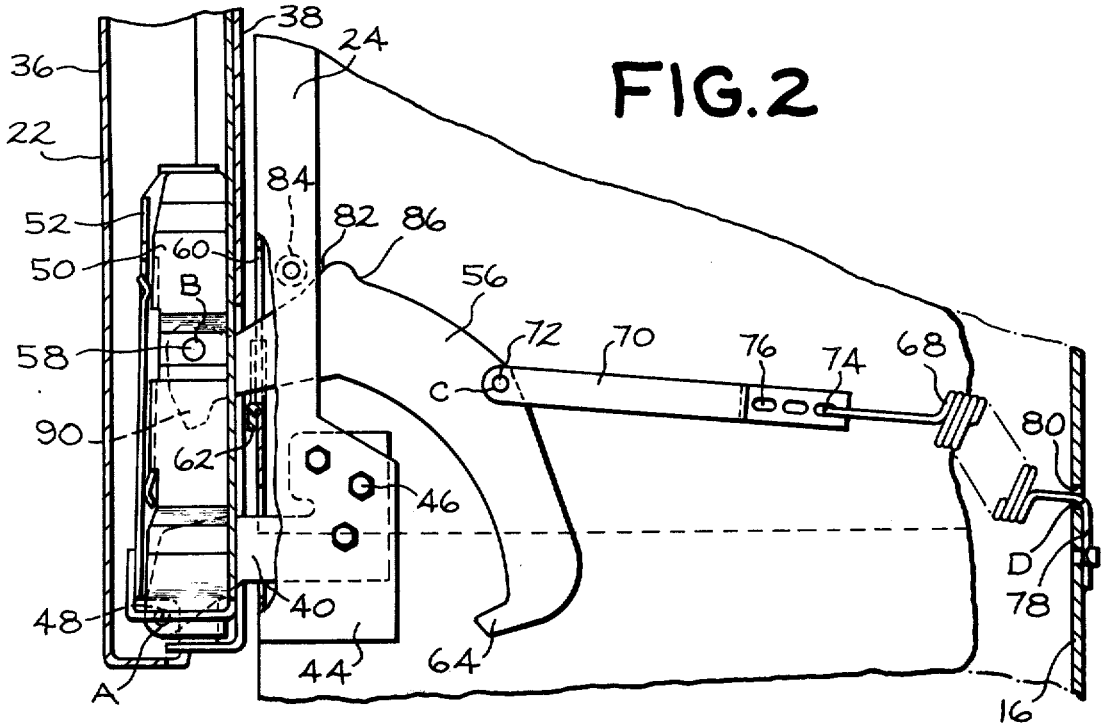
FIG. 2 is a fragmentary cross-sectional, elevational view on an enlarged scale of the hinge and counterbalance spring mechanism for the door, taken on the line 2—2 of FIG, 1, but showing the door in its vertical closed position.

A generally horizontal tension spring 68 is combined with the hinge lever 56 as part of a counterbalance spring mechanism. Actually, there is a swing link 70 interposed between the tension spring 68 and the hinge lever 56, as is best seen in FIG. 2. This swing link 70 is in the form of two parallel link members pivoted to the hinge lever 56 by a pivot pin 72, with one link member on either side of the hinge lever 56 so as not to apply a twisting force to the hinge lever. The tension spring 68 is provided with a hook end 74 for engaging in one of several possible slots 76 in the innermost end of the swing link 70. The opposite end of the tension spring 68 is also provided with a hook end 78 for engagement in a slot 80 in a fixed partition or flange at the rear of the oven cabinet 16.

As is generally standard in this art, the hinge lever 56 is provided with a cam surface 82 on its top edge adjacent the door to cooperate with a roller 84 that is assembled behind the slot 60 for engagement with the cam 82. Hence, the pulling force of the tension spring 68 on the hinge lever 56 serves as a closing force on the door, as well as to hold the door in the closed position so that it may not inadvertently swing open. Behind the raised cam surface 82 is a declining cam surface 86 such that when the oven door 22 is opened by about 15° the declining cam surface 86 serves as a broil stop position and thereby provides a detent action to prevent the door from being closed by the pulling action of the tension spring 68. The reason for this is that for normal broiling operation it is important to leave the oven door partially open so that room ambient air may flow through the oven cooking cavity. This broil position of the door is to be distinguished from a baking position when the oven door is to remain in its vertical closed position Attention is directed to FIG. 2, and to the downward extension 90 formed on the hinge lever 56 beneath the pivot point 58. In the vertical closed position of FIG. 2, this downward extension 90 is free to move as the hinge lever 56 pivots with respect to the door guide 50 and hence, the door 22. However, when the oven door 22 hinges open as seen in FIG. 3 to an angle between about 20° and 35° measured from the vertical closed position, this downward extension 90 will bear against a surface of the door guide 50 thereby making the hinge lever 56 fixed or rigid with respect to the door guide 50. Hence, for all further movement of the oven door 22 from that position down to its horizontal fully open position, the hinge lever 56 remains fixed with respect to the door guide and to the door proper.

For the sake of simplicity in explaining the nature of the torque created by the door moving about its hinge axis 48 and of the torque exerted by the counterbalance system, the various hinge points will be identified by the following letters: the hinge axis of the door created by pivot pin 48 is identified as point A. The hinge axis created by the pivot pin 58 between the hinge lever 56 and the door guide 50, and hence with respect to the door 22 is point B. The hinge axis created by the pivot pin 72 between the swing link 70 and the hinge lever 56 is point C. Lastly, the hinge axis created by the hook end 78 of the tension spring 68 with respect to the slot 80 is identified as point D.

A force applied to a body may produce rotation about some axis. The force exerted by the weight of the oven door 22 may produce rotation about the hinge axis A, if there were no counterbalance spring mechanism. This rotational effect is known as the moment of force, or torque and is measured as the product of the force and the perpendicular distance from the axis of rotation to the line of action of the force. This perpendicular distance may also be called the moment arm. Torque equals force times moment arm. The torque of the door 22 equals the weight of the door as represented by a vertical force component located at the center of gravity (not shown) of the door, while the moment arm is the perpendicular distance from point A to the vertical component of the weight of the door. This torque of the door is shown in the graph of FIG. 4 as curve F.

The torque of the door counterbalancing forces has a changing moment arm dependng upon the door angle position from the vertical closed position to the horizontal open position. Generally speaking, the force of the balancing torque is provided by the tension spring 68. There is an initial phase to the opening movement of the door, from the closed position of FIG. 2 to the rigid position of FIG. 3, when the hinge lever 56 becomes fixed or rigid with respect to the door guide 50 when the hinge lever extension 90 bears against a surface of the door guide as mentioned above. During this initial movement between 0° and somewhere between 20° and 35°, the moment arm is equal to the perpendicular distance from point A to an imaginary line drawn between points B and C. There is a slight complication when the cam surfaces 82 and 86 are bearing against the roller 84 because this tends to force the hinge lever 56 downward such that the line of force of the tension spring 68 is not in line with both points B and C. When this occurs, the force is equal to the force of the tension spring 68 times cosine of the included angle between the imaginary line between points B and C and the longitudinal axis of the tension spring 68, which longitudinal axis coincides with the line drawn between points C and D. As the oven door 22 moves downward beyond the position shown in FIG. 3, the moment arm may then be measured as the perpendicular distance from point A to an imaginary line drawn between points C and D. This torque of the counterbalancing spring mechanism is plotted as curve G in the graph of FIG. 4, and it should be noticed that this balancing torque substantially follows closely behind the torque of the door. That is except in the initial phase of the opening of the door, when the cam surfaces 82 and 86 are acting against the roller 84, for the purpose of a broil stop position.

Figure 4:
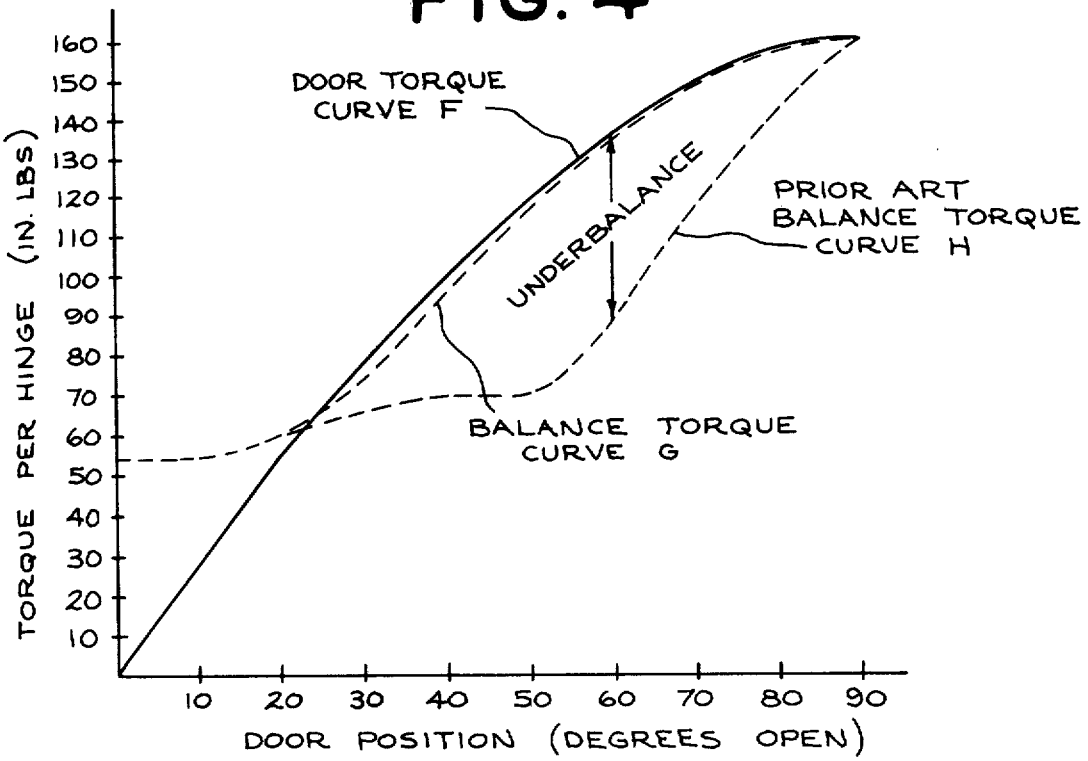
FIG. 4 is a graph plotting several curves showing the door position in angular degrees open measured from the datum plane of the vertical closed position as compared with the door and balancing torque exerted at each hinge of the door measured in inch-pounds.

In order to give an example of the improvement created by the use of the present invention in comparison with the prior art where the tension spring 68 would be connected to the hinge lever 56 near a point adjacent the hook portion 64 of the hinge lever, there is a third curve, curve H shown in FIG. 4. Here the balancing torque fades away in the latter phase of the door movement such that the door would tend to fall rapidly. Also, when closing the door a much larger closing force must be provided by the user. As mentioned previously, this counterbalancing problem does not arise when the tension spring may be arranged in a generally vertical position. The problem that has been solved by the use of the present invention mainly arises when the tension spring may only be positioned in a generally horizontal position, which occurs because of the absence of a drawer space beneath the oven in which the counterbalance system may be installed.

It has been found desirable that the hinge point C between the swing line 70 and the hinge lever 56 should be located forwardly of the hinge axis A when the oven door 22 is in its horizontal fully open position. Thus a plot of the moment arm versus the door angular position would show the moment arm of this invention and the prior art being about equal for the initial phase of the movement until the hinge lever becomes rigid at between 20° and 35°. Then the moment arm of this invention tends to increase while the moment arm of the prior art decreases. Both curves peak between 50° and 60°, and then they reverse direction until they substantially coincide at the 90° fully open position.

Modifications of this invention will occur to those skilled in this art, therefore, it is to be understood that this invention is not limited to the particular embodiments disclosed but that it is intended to cover all modifications which are within the true spirit and scope of this invention as claimed.

I claim:

1. An appliance comprising an outer cabinet with a front-opening access door, the cabinet having a front frame forming a door opening, and hinge means connecting the door to the cabinet so the door may move between a vertical closed position and a generally horizontal open oposition, hinge lever means pivotally connected to the door and generally overlying the said hinge means, a slot means in the front frame for accommodating the hinge lever means therethrough, a link means pivotally connected to the hinge lever means, and a generally horizontal tension spring means connected at one end to the link means and at its other end to the said cabinet near the rear thereof, the said hinge lever means becoming fixed with respect to the door starting at an angle between about 20° and 35° and continuing until the door reaches the horizontal fully open position, said link means being attached to the said hinge lever means at a point outwardly of the door frame when the door is in its fully open position whereby the weight of the door is substantially balanced throughout its entire range of door movement.

2. An appliance as recited in claim 1 wherein the innermost portion of the said hinge lever means is provided with a stop means for engaging said front frame when the door reaches its fully open position to arrest the movement of the door beyond this point, the said pivotal connection of the link means to the hinge lever means being at a point near the center of the hinge lever means.

3. An appliance as recited in claim 1 wherein the said pivotal connection of the link means to the hinge lever means is at a point near the center of the hinge lever means.

4. An appliance as recited in claim 3 wherein the counterbalance torque on the door during the initial portion of its movement between the vertical fully closed position and the point when the hinge lever means becomes fixed has a moment arm that is measured as the perpendicular distance between the pivotal axis of the door hinge means and an imaginary line drawn through the axis of the pivotal connection between the hinge lever means and the door and the axis of the pivotal connection between the hinge lever means and the said link means.

5. An appliance as recited in claim 4 wherein the counterbalance torque on the door during the portion of its movement between the point when the hinge lever means becomes fixed and the horizontal fully open position has a moment arm that is measured as the perpendicular distance between the pivotal axis of the door hinge means and an imaginary line drawn through the axis of the pivotal connection between the hinge lever means and the said link means and the point of connection of the tension spring to the said cabinet.

6. An appliance as recited in claim 1 wherein the said hinge means is duplicated at each side of the door and comprises a door bracket fixed to the said cabinet and a door guide pivoted to the door bracket, the door including a door guide sleeve for receiving the door guide in a snug fit, whereby the door may be removed from the pair of door guides, the said hinge lever means being pivoted to the said door guide whereby the door guide serves as part of the door proper.

* * * * *